US007409748B2

(12) United States Patent
McGuire

(10) Patent No.: US 7,409,748 B2
(45) Date of Patent: Aug. 12, 2008

(54) METHOD OF MAKING HIGH LOFT NONWOVEN

(75) Inventor: Sheri L. McGuire, O'Fallon, MO (US)

(73) Assignee: Western Nonwovens, Inc., Carson, CA (US)

( * ) Notice: Subject to any disclaimer, the term of this patent is extended or adjusted under 35 U.S.C. 154(b) by 302 days.

(21) Appl. No.: 11/274,982

(22) Filed: Nov. 15, 2005

(65) Prior Publication Data

US 2006/0076106 A1 Apr. 13, 2006

Related U.S. Application Data

(62) Division of application No. 10/449,279, filed on May 30, 2003, now abandoned.

(51) Int. Cl.
*D01G 25/00* (2006.01)

(52) U.S. Cl. ..... 19/161.1

(58) Field of Classification Search ..... 19/161.1, 19/296

See application file for complete search history.

(56) References Cited

U.S. PATENT DOCUMENTS 5,252,386 A 10/1993 Hughes et al.
5,296,289 A 3/1994 Collins
5,475,903 A 12/1995 Collins
5,873,964 A * 2/1999 Kwok ..... 156/62.8
5,928,973 A * 7/1999 Daniel et al. ..... 442/407
6,375,773 B1 * 4/2002 Andersen ..... 156/148
2007/0202294 A1 * 8/2007 Ogle et al. ..... 428/68

* cited by examiner

*Primary Examiner*—Shaun R Hurley
(74) *Attorney, Agent, or Firm*—Clements Bernard Miller; Gregory N. Clements

(57) ABSTRACT

The present invention relates to a process for making high loft, nonwoven material by providing either natural and/or synthetic fibers, providing a low melt binder fiber, mixing the low melt binder fiber and the natural and/or synthetic fibers to form a web, cross-lapping the web, drafting the web with a drafter, heating the drafted web to a temperature sufficient to melt the low melt binder fibers, and cooling the web thereby forming a structural nonwoven material. The nonwoven batt can be cross-lapped between 2 and 10 layers and when the batt is cooled and has structural rigidity, the tensile strength in the machine direction is at least 50% of the tensile strength in the cross-direction. The batt weight is in a range of 0.25 oz/ft$^2$ to 2.0 oz/ft$^2$. The low melt binder fibers comprise 10 to 30 wt. % of the nonwoven batt and the synthetic and/or natural fibers comprise about 70 to 90 wt. %. This product is useful for nonwoven applications in indoor and outdoor furniture, quilting, bed covers and mattresses specifically.

17 Claims, 1 Drawing Sheet

10
16
14
18
14
20
14
24
22
12
14
26
28

METHOD OF MAKING HIGH LOFT NONWOVEN

CROSS-REFERENCE TO RELATED APPLICATION

This application is a division of U.S. Ser. No. 10/449,279 filed May 30, 2003 now abandoned by the same inventor and assignee.

BACKGROUND OF THE INVENTION

1) Field of the Invention

The present invention relates to a high loft having balanced properties and a method of making the same for the production of nonwoven fabric. In particular, the present invention relates to a lightweight, high loft nonwoven fabric in which properties in the machine direction and cross direction such as resiliency (measured in terms of improved loft), and improved tensile strength are more uniform. Additionally, a process for making the high loft nonwoven is unique in that a drafter machine is employed, thereby increasing the efficiency of the production process.

2) Prior Art

High loft nonwoven fabrics are used in a wide variety of applications, for example, in indoor and outdoor furniture, bedding such as mattresses, and quilting. As such, there is always a need to improve the quality of nonwoven fabrics to enhance their function with existing uses, and to add their application to new uses. Moreover, from an economics standpoint, it is desirous to improve the process of producing nonwoven fabric in order to increase production rate.

High loft, nonwoven fabrics are principally formed of a polyester blend having a low melt binder. The low melt binder is either a bicomponent fiber, or a low melting fiber having a lower melting temperature than the polyester fiber, or a latex resin applied to the fibers, either as a spray or a powder.

Two principle characteristics of high loft nonwoven fabrics are product resiliency and tensile strength. Product resiliency refers to the capability of the fabric to return to its original shape after having been compressed. For example, it is desirable that a cushion, mattress, or similar item returns to its original form after use, such as after being sat upon by a person. Also, during shipping, the product is usually vacuumed down to reduce shipping volume. As such, it is important that the product returns to its original state upon unpacking.

Tensile strength refers to the capacity of the fabric to resist a load applied in tension and is measured in the machine and cross directions. Machine direction refers to the direction in which the nonwoven material is manufactured and processed, and cross direction is transverse to the machine direction.

Other important measures of quality include product uniformity, product compression recovery, and the amount of false loft exhibited by the product. Product uniformity refers to the degree of fiber alignment in both the machine and cross directions, such that the product possesses more uniform physical properties. Compression recovery and false loft are related to resiliency in that they affect fabric's ability to return to its original shape. For example, a fabric with false loft will have a high initial loft due to excessive voids within the fabric. Upon removal of an applied load, the fabric will be compressed into the voids and will not return to its original form.

In a conventional process for making high loft nonwoven fabric, wherein low melt fibers are used as the binder, polyester fibers and low melt fibers are blended together in a hopper, for example, and deposited onto a moving conveyor belt forming a batt. The speed of the conveyor belt determines the thickness of the batt. Movement of the conveyor belt naturally orients the majority of the fibers in the machine direction. However if higher tensile strengths are desired, more orientation in the machine direction will provide this effect. For example, the fibers may be carded to align the fibers more uniformly in the machine direction to give higher tensile strengths. To provide tensile strength in the cross direction a cross lapper layers the fibers over the machine direction laid fibers to thicken and strengthen the web. The web is then passed through an oven having sufficient heat to melt the low melt fibers, causing them to bind to the other fibers, thereby strengthening and improving resiliency of the web. After leaving the oven, the properties of the web are set in a cooling zone and the batt is wound for shipping to customers. This is the conventional process for producing the highest quality high loft product.

This conventional process is limited in that tensile strength of the web in the cross direction is higher than the tensile strength in the machine direction. Another drawback of the conventional process is that the low melt fibers typically constitute twenty percent (20%) or more of the web, by weight. These low melt fibers are more expensive than the polyester fibers, adding cost to the product.

A further limitation of the conventional process is that the production rate is limited by the cross-lapper. That is, the faster the production rate, the more inconsistent the fibers are laid when cross lapped. Moreover, the cross lapper is incapable of cycling back and forth at a speed sufficient to keep up with the speed of the other production components. This is particularly a problem for lightweight, nonwoven fabrics wherein inconsistently laid fibers reduce the fabrics' quality and diminishes physical properties of the product.

An alternative to using a low melt fiber as a binder in a conventional process for producing high loft nonwoven fabrics is to spray a latex resin onto the polyester fibers. The latex resin is applied in a spraying area sequentially located between the cross lapper and oven. Disadvantageously, the step of applying resin is also quite slow in comparison to the process speed of the remaining equipment, causing another process restriction point. Moreover, the latex resin causes the fabric to have a stiff feel.

It is the object of the present invention to provide a process for producing high loft nonwoven fabric at a faster production rate than conventionally accomplished. It is also an object of this invention to provide a product and process for producing high loft nonwoven fabric having comparable and in most cases superior quality, particularly having uniformity in tensile strength in the machine and cross directions. Further, it is an object of this invention to provide a product for making high loft nonwoven fabric that has improved product uniformity, enhanced compression recovery, and a reduction in false loft. Still further, it is an object of this invention to provide a product and process that produces a high loft nonwoven fabric, containing a reduced amount of low melt fibers, that is comparable or superior to fabric produced by a conventional process.

The present invention achieves these objectives in producing nonwoven fabric by adding a drafter within an existing high loft nonwoven process, between the cross lapper and oven. The drafter functions in its conventional sense, but its use in producing high loft nonwoven fabric is novel, thus producing novel products, and the benefits to product quality and increased production rate resulting therefrom was unexpected.

Drafters are known to those skilled in the textile art for producing thin fabrics. Drafters are typically used in processes which include needle punching, wherein the needle punching strengthens the web. However, their use in producing lightweight, high loft nonwoven fabric, is not known.

Applicant is aware of the following U.S. patents concerning a process having a drafter for producing nonwoven fabric.

U.S. Pat. No. 5,475,903, issued to Collins on Dec. 19, 1995, describes a hydroentangled, nonwoven fabric having comparable strength in the machine and cross directions. The process includes carding, cross lapping, drafting and hydroentaglement to create a thin fabric suitable for use in hospital gowns. The hydro entanglement step imparts comparable strengths to the fabric in the machine and cross directions. Since the process relates to manufacturing a thin fabric, there is no consideration of product resiliency.

U.S. Pat. No. 5,252,386, issued to Hughes et al. on Oct. 12, 1993, describes a process for making an entangled nonwoven fabric having balanced strength properties in the machine and cross directions and improved fire retardancy. These characteristics are achieved by cross-stretching the entangled fabric after the fabric has been wetted with an aqueous-based fire retardant composition and drying the wetted fabric while maintaining it in its stretched state.

Another example of a nonwoven fabric having comparable strength in the machine and cross directions is illustrated by U.S. Pat. No. 5,296,289, issued to Collins on Mar. 22, 1994. Collins discloses a spun bonded nonwoven web having spaced autogenous spot bonds, wherein spot bonds are distributed in a cornrow pattern to form a web having improved strength.

Conventionally formed high loft nonwoven fabrics have limited use since their tensile strength in the machine direction is significantly less than that in cross direction. Moreover, improvement is also desired in other measures of product quality, such as fiber uniformity, resiliency, compression recovery, and reduction in false loft.

Conventional processes for forming high loft nonwoven fabrics also have process components that limit production rate well below that of the remaining equipment. The cross lapper typically limits the rate of production in that it is incapable of obtaining the production speeds of the remaining equipment.

Conventional processes that spray resin as a binder onto the web have a production rate much slower than those that utilize low melt fibers because the step of applying resin causes a process restriction point. Also the oven cure residence time to dry and cure the sprayed binder resin impedes the production process compared with using low melt fibers. Using low melt fibers, on the other hand, is often more expensive than spraying a binder resin.

SUMMARY OF THE INVENTION

The present invention relates to a product and process for making a lightweight, high loft nonwoven fabric. The process adds a drafter to a conventional nonwoven process in order to increase the production rate. Additionally, the invented process improves the quality of the manufactured fabric by increasing the tensile strength in the machine direction, providing balanced strength in the machine and cross directions, and enhancing resiliency of the fabric.

Preferably, the invented process provides a fabric having tensile strength in the MD and CD that is at least 50% of one another, and more preferably at least 60% of one another (within 40% of one another). Most preferably the high loft nonwoven fabric has tensile strengths in the MD and CD that is at least 80% of one another (within 20% of one another).

In the broadest sense, the present invention relates to a process for forming a high loft, nonwoven fabric in which the process includes the steps of providing a fiber, a binder, and a drafter for drafting the batt of fiber and binder. Preferably, the fiber is made of polyester and the binder is either a low melt binder fiber or a bicomponent fiber. More preferably, the weight of the fabric is no more than 2.0 oz/ft$^2$, and most preferably the weight of the fabric is in the range of 0.25 oz/ft$^2$ to 1.8 oz/ft$^2$.

In the broadest sense, the present invention also relates to a process for forming a high loft nonwoven material in which the process includes the steps of providing natural and/or synthetic fibers, and low melt binder fibers. The natural and/or synthetic fibers and low melt fibers are mixed, optionally carded, cross lapped, drafted, heated and cooled to form the nonwoven material. Preferably, the nonwoven fabric has a tensile strength in a machine direction that is at least 50 percent or the tensile strength in a cross direction.

In the broadest sense, the present invention also relates to a high loft, nonwoven fabric wherein the weight of the fabric is in the range of 0.25 oz/ft$^2$ to 1.8 oz/ft$^2$, the tensile strengths in the CD and MD are within 40% of one another, and the loft recovery is 90% or more.

BRIEF DESCRIPTION OF THE DRAWINGS

The drawing of the present invention is used to help illustrate, describe, and convey the general concept of the overall invention. Accordingly, it is for illustrative purposes only and not meant to limit the scope of the invention and claims in any manner.

DESCRIPTION OF THE PREFERRED EMBODIMENTS

Figure 1:
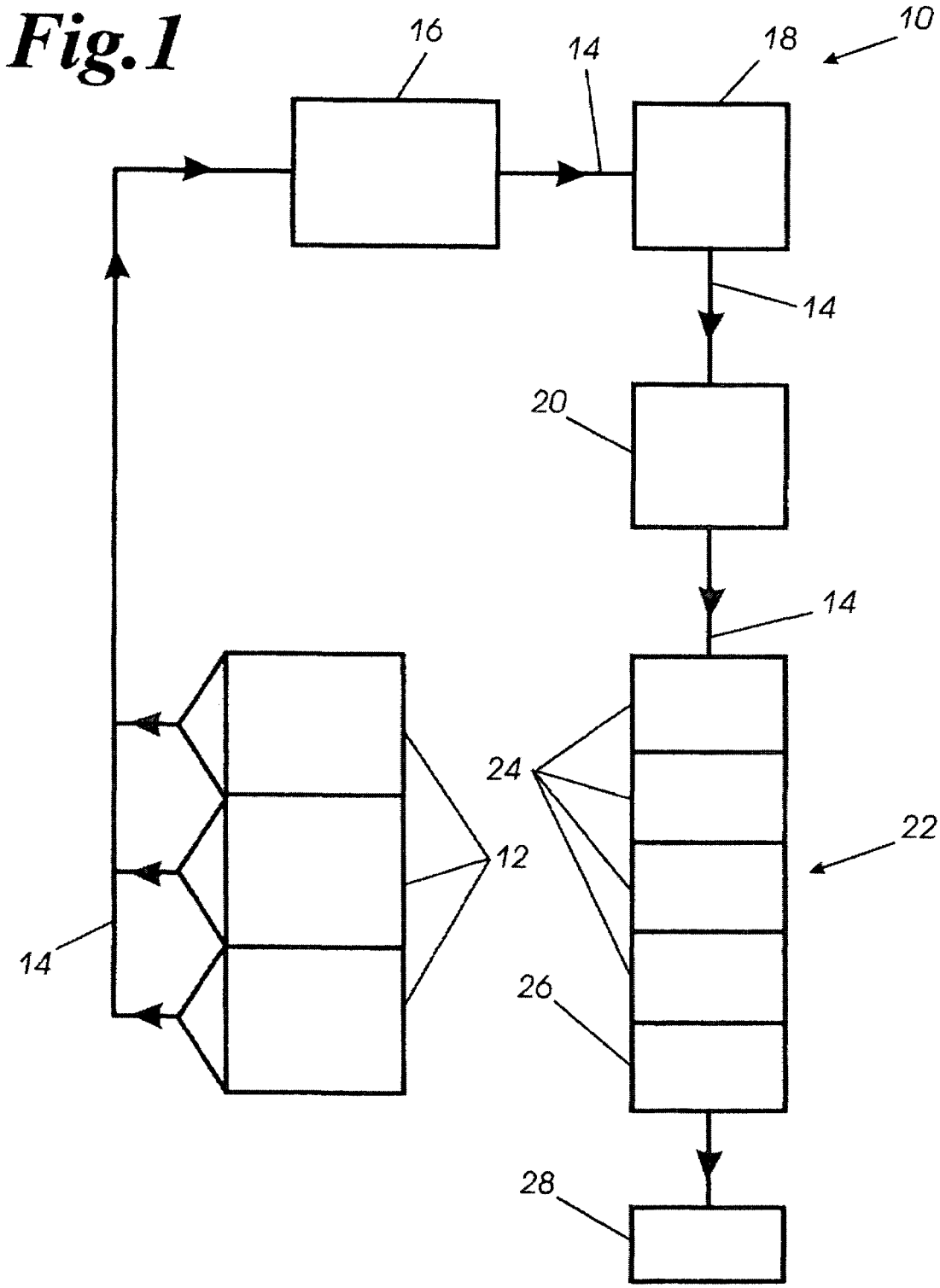
FIG. 1 is a flow diagram of the invented process for producing high loft nonwoven fabric.

The present invention is an improved product and process for producing lightweight, high loft nonwoven fabric. For purposes of this application, light-weight fabric is considered to be fabric having a weight of <2.0 oz/ft$^2$ and more preferably having a weight in the range of 0.25 oz/ft$^2$ to 1.8 oz/ft$^2$. The present invention comprises a nonwoven batt having natural and/or synthetic fiber and a binder.

The synthetic fiber can be polyester such as polyethylene terephthalate, polybutylene terephthalate, polyethylene naphthalate, or polypropylene terephthalate, or a mixture of these; polyamide such as nylon 6 or nylon 6,6, or a mixture of these; polyolefin such as polyethylene or polypropylene, or a mixture of these; polyacrylic such as polyacrylonitrile, cellulose acetate, melamine, and rayon, or a mixture of these, or copolymers based on any of these.

The natural fiber can be, for example, cotton, wool, flax, kenaf, hemp, silk, jute, asbestos, and ramie. Natural fibers are generally fibers from animals, minerals, or plants. Mixtures of various natural fibers are also within the scope of this invention.

The binder can be a latex resin, a low melt polymer fiber or powder, or a bicomponent fiber. The binder is typically employed at about 5 to about 25 percent by weight of the nonwoven batt, to provide sufficient bonding and resiliency for various applications. Generally no more than 30% by weight of the nonwoven batt (fabric) is binder. Latex resin used as binders are well known and most are suitable for the present invention so long as they have adequate strength and durability and have no odor or safety concerns (fire or noxious gases) problems. Common low melt polymers include polyolefin, polyester, copolyester, and copolyolefin which can be in fiber form (preferable), powder form, or applied like a hot melt adhesive. The low melt fibers must have a lower melting point than the synthetic fibers. Bicomponent fibers are also known to those skilled in the art and include side-by-side and sheath-core arrangements wherein the high melt component is the core and the low melt component forms the sheath. Such bicomponent fibers may be based upon polyolefin/polyester, copolyester/polyester, polyester/polyester, polyolefin/polyolefin, and copolyolefin/polyolefin wherein the naming convention is the low melt component followed by the high melt component.

Referring to the drawing, and in particular to FIG. 1, the process 10 includes several blend hoppers 12 for supplying a desired blend of fibers or a single fiber type. The fibers are typically natural and/or synthetic and may have fire retardant properties, a silicon finish to provide a slick fiber, or other characteristics. From the hoppers 12, the fibers are blended into a batt by being weighed, and then air laid onto a moving conveyor belt 14, for example. The desired batt thickness and weight, measured in terms of ounces per square foot, is controlled by the conveyor belt speed. The batt fibers are then carded 16 to align the fibers uniformly in a web, oriented in the machine direction. Thereafter, the conveyor belt 14 moves the web to a cross lapper 18 where a predetermined number of layers are applied, back and forth, in cross direction to build-up the web to a desired weight and thickness and to provide tensile strength in the cross direction. Following the cross lapper 18 comes the drafter 20, which pulls the web or batt in the machine direction to better balance the properties with the cross direction.

The nonwoven web is then passed through an oven 22 having a series of heated zones 24 wherein the low melt binder is melted and cured according to standard practice. In lieu of using low melt fiber as a binder, a conventional process may spray latex resin onto the batt or web. In such an arrangement, the conveyor 14 carries the web to a spray area (not shown) sequentially positioned between the drafter 20 and oven 22. Thereafter, the nonwoven web is passed through a cooling zone 26, allowing the low melt binder to re-solidify to set the web properties. The web is wound up on a winding head 28, and ready for use in furniture, mattresses, and other applications.

The drafter 20 is of a conventional type, such as an Asselin Drafter. The drafter 20 includes several zones, wherein each zone includes multiple rollers. The rollers nip the web, compressing and pulling the web in the machine direction. The speed of each zone of rollers is the same as or progressively increased so that the web becomes attenuated or stretched during its passage therethrough.

Notwithstanding the conventional nature of the drafter 20, its application in producing lightweight, high loft nonwoven fabric surprisingly allows for the fabric to be processed at a significantly higher rate than with the conventional process. Moreover, use of the drafter unexpectedly and dramatically improves the quality of the fabric. In particular, use of the drafter improves fabric resiliency, increases tensile strength in the machine direction, and yields a fabric having more uniform tensile strength in the machine and cross directions. Other measures of quality, such as the amount of false loft, compression recovery and product uniformity also benefit from the operation of the drafter. Heretofore, the use of a drafter on high loft fabric was thought to be worthless because the tensile strength could be balanced by other means and it was thought that the drafter would easily pull apart the web or batt, since it is light weight and full of void areas to create loft.

In particular, the drafter in compressing, nipping and pulling the web, tends to improve fiber uniformity, negating some of the effects of fiber misalignment caused by the cross lapper. The velocity of the web actually increases as it traverses through the drafter. Accordingly, the overall process rate in manufacturing high loft fabric can be increased.

The use of the drafter also yields a more resilient fabric and removes false loft from the web by compressing and stretching the fibers. The amount of compression is set by the gap between the rollers and is also determined by the weight of the web. Although the rollers can be set to interferingly engage, it is preferred that the rollers are slightly gapped apart, such as for example from 0.5 mm to 40 mm, in order to avoid excessive compression of the web which may reduce the initial loft of the fabric. Notwithstanding and not to be construed as limiting, it is found that a gap between 0 to about 40 mm, depending on the weight of the web, provides significant improvement to the quality of lightweight, high loft nonwoven fabric.

Test Procedures

The properties of the webs were measured according to the following procedures:

Web Strength

The tensile strength of each web was measured according to the ASTM test method set forth in reference ASTM D91-93—Section 12, Tensile Strength, "Breaking Load" and "Specific Strength". A 250 lb load cell for high loft products was used with the pounds at break recorded.

Loft

The loft under various loads was measured with a loft tester having a pressure foot with an area of 12 inch×12 inch. Two nonwoven 12 inch×12 inch sheets were cut and stacked in the tester. The pressure foot was lowered until it came into contact with the stack of nonwoven sheets. The thickness was then measured and reported as initial loft ($L_1$ inch). The pressure foot was applied to the fabric and stopped for 2 minutes, at each of the following loads, 5, 10, 15 and 20 lbs, and the thickness measured at each load. The pressure foot was then moved completely clear from the nonwoven stack. After allowing the sample to relax for 5 minutes, the thickness ($L_R$ inch) was measured.

percent loft recovery is:

$$(L_R/L_I)\times 100$$

Test results illustrating the effect of including the drafter compared to the conventional process are shown in Tables 1-9. Fabrics made by the conventional process are identified as Control and fabrics that were made by the invented process are identified as Sample. The Tables show that use of the drafter enhances product resiliency, as measured by percent loft recovery, decreases false loft and allows for an increased production rate. In each experiment, testing was performed with zero gap between the rollers of the drafter.

EXAMPLE 1

Referring to Table 1, the quality of a Control high loft nonwoven fabric and three Sample fabrics are compared. Each of the fabrics had a weight of 0.75 oz/ft$^2$ and a weight percent blend of: 20% 4 dpf (denier per filament) low melt binder fiber, 30% 25 dpf PET, and 50% 15 dpf PET. The Samples were processed with different number of layers, with the Control, First Sample, Second Sample and Third Sample respectively having 2, 2, 3 and 4 layers. In order to maintain the same weight (oz/ft$^2$), the process rate was adjusted, with the Control, First Sample, Second Sample, and Third Sample respectively processed at 1278 lbs/hr, 1775 lbs/hr, 1896 lbs/hr and 1896 lbs/hr.

TABLE 1

Percent Loft Recovery for 0.75 oz/ft$^2$ Control and Samples

| Applied Load (lbs) | Loft (inches) | Percent Loft (%) |
|---|---|---|
| Control | | |
| Blend (20% 4 dpf low melt, 30% 25 dpf PET, and 50% 15 dpf PET) | | |
| Rate: 1278 lbs/hr | Weight: 0.75 oz/ft$^2$ | Number of Laps: 2 |
| Zero | 1.75 | 100 |
| 5 | 1.39 | 79.4 |
| 10 | 1.18 | 67.4 |
| 15 | 1.03 | 58.9 |
| 20 | 0.93 | 53.1 |
| Load removed | 1.68 | 96.0 |
| | | (% loft recovery) |
| Sample 1 | | |
| Blend (20% 4 dpf low melt, 30% 25 dpf PET, and 50% 15 dpf PET) | | |
| Rate: 1775 lbs/hr | Weight: 0.75 oz/ft$^2$ | Number of Laps: 2 |
| Zero | 1.55 | 100 |
| 5 | 1.3 | 83.9 |
| 10 | 1.14 | 73.5 |
| 15 | 1.03 | 66.5 |
| 20 | 0.94 | 60.6 |
| Load removed | 1.5 | 96.8 |
| | | (% loft recovery) |
| Sample 2 | | |
| Blend (20% 4 dpf low melt, 30% 25 dpf PET, and 50% 15 dpf PET) | | |
| Rate: 1896 lbs/hr | Weight: 0.75 oz/ft$^2$ | Number of Laps: 3 |
| Zero | 1.51 | 100 |
| 5 | 1.24 | 82.1 |
| 10 | 1.08 | 71.5 |
| 15 | 0.97 | 64.2 |
| 20 | 0.88 | 58.3 |
| Load removed | 1.46 | 96.7 |
| | | (% loft recovery) |
| Sample 3 | | |
| Blend (20% 4 dpf low melt, 30% 25 dpf PET, and 50% 15 dpf PET) | | |
| Rate: 1896 lbs/hr | Weight: 0.75 oz/ft$^2$ | Number of Laps: 4 |
| Zero | 1.61 | 100 |
| 5 | 1.31 | 81.4 |
| 10 | 1.08 | 67.1 |
| 15 | 0.98 | 60.9 |
| 20 | 0.87 | 54.0 |
| Load removed | 1.56 | 96.9 |
| | | (% loft recovery) |

The present loft recovery for the Samples ranged from 96.7% to 96.9% which is superior to the 96.0% recovery exhibited by the Control. This improvement in resiliency is advantageous in preserving the fabric's loft and shape during shipment and use. The testing also demonstrated that the invented process reduced the amount of false loft in the fabric. False loft is indicated by the percent of loft lost between the initial loft and the loft at the applied load. As shown in the Table 1, the Samples performed superior to the Control, exhibiting less false loft. Moreover, it is noted that the improvements in fabric resiliency and false loft was achieved at substantially higher production rates.

Table 2 is the tensile strength of the Control and the three Sample fabrics identified in Table 1.

TABLE 2

(Tensile Strength in pounds)

| | CONTROL | SAMPLE 1 | SAMPLE 2 | SAMPLE 3 |
|---|---|---|---|---|
| MD | 1.33 | 2.78 | 7.09 | 9.19 |
| CD | 5.30 | 4.44 | 5.52 | 4.57 |

Table 2 illustrates a great disparity between tensile strength in the cross direction and machine direction for the Control Sample, with strength in the machine direction being significantly less than that in the cross direction. In comparison, tensile strength in machine direction for each of the drafted Samples was substantially improved from that of the Control. Specifically, Sample 1, having the same number of laps as the Control, provides an increased tensile strength from of load of 1.33 lbs to 2.78 lbs. Samples 2 and 3 each demonstrate an even more dramatic increase in machine direction tensile strength.

EXAMPLE 2

Referring to Table 3, a Control high loft, nonwoven fabric and two Sample fabrics are compared wherein each of the fabrics had a weight of 1.0 oz/ft$^2$ and a weight percent blend of: 20% 4 dpf low melt binder fiber, 30% 25 dpf PET, and 50% 15 dpf PET. The Samples were processed with different number of laps, with the Control, First Sample and Second Sample having 3, 3 and 4 laps, respectively. The process rate was adjusted in order to maintain the same weight (oz/ft$^2$), with the Control, First Sample and Second Sample respectively processed at 920 lbs/hr, 1050 lbs/hr and 1100 lbs/hr.

TABLE 3

Percent Loft Recovery for 1.0 oz/ft$^2$ Control and Samples

| Applied Load (lbs) | Loft (inches) | Percent Loft (%) |
|---|---|---|
| Control | | |
| Blend (20% 4 dpf low melt, 30% 25 dpf PET, and 50% 15 dpf PET) | | |
| Rate: 920 lbs/hr | Weight: 1.0 oz/ft$^2$ | Number of Laps: 3 |
| Zero | 2.82 | 100 |
| 5 | 2.14 | 75.9 |
| 10 | 1.75 | 62.1 |
| 15 | 1.43 | 50.7 |
| 20 | 1.3 | 46.1 |
| Load removed | 2.7 | 95.7 |
| | | (% loft recovery) |
| Sample 1 | | |
| Blend (20% 4 dpf low melt, 30% 25 dpf PET, and 50% 15 dpf PET) | | |
| Rate: 1050 lbs/hr | Weight: 1.0 oz/ft$^2$ | Number of Laps: 3 |
| Zero | 2.57 | 100 |
| 5 | 2.07 | 80.5 |
| 10 | 1.73 | 67.3 |
| 15 | 1.46 | 56.8 |
| 20 | 1.34 | 52.1 |
| Load removed | 2.47 | 96.1 |
| | | (% loft recovery) |
| Sample 2 | | |
| Blend (20% 4 dpf low melt, 30% 25 dpf PET, and 50% 15 dpf PET) | | |
| Rate: 1100 lbs/hr | Weight: 1.0 oz/ft$^2$ | Number of Laps: 4 |
| Zero | 2.98 | 100 |
| 5 | 2.37 | 75.9 |
| 10 | 1.97 | 62.1 |
| 15 | 1.7 | 50.7 |
| 20 | 1.52 | 46.1 |
| Load removed | 2.9 | 97.3 |
| | | (% loft recovery) |

Again, the step of drafting improved the resiliency of the fabric, as measured by percent loft recovery. Here, the percent recovery for Samples 1 and 2 were respectively 96.1% and 97.3%, compared to a loft recovery of 95.7% for the Control. Also, the Samples had the same or less false loft than the Control. These improvements in fabric quality were obtained even at production rates higher than that of the Control.

Table 4 is the tensile strength of the Control and Samples of Table 3.

TABLE 4

| (Tensile Strength in pounds) | | | |
|---|---|---|---|
| | Control | Sample 1 | Sample 2 |
| MD | 3.0 | 7.0 | 10.25 |
| CD | 8.75 | 9.1 | 7.25 |

Table 4 illustrates that by adding the drafter to the non-woven process, tensile strength in the machine direction was substantially improved while tensile strength in the cross direction remained relatively unchanged. As such, tensile strength in the machine and cross directions if more uniform.

EXAMPLE 3

Because the drafter provides a more balanced fabric (with respect to certain physical properties), it is possible to lower the amount of binder and still achieve good tensile strength properties. Table 5 compares the Control having 20% binder and the Samples each of which had a weight of 1.0 oz/ft$^2$ and a weight percent blend of: 10% 4 dpf low melt binder fiber, 35% 25 dpf PET, and 55% 15 dpf PET.

TABLE 5

| Loft Recovery for 1.0 oz/ft$^2$ Control and 10% Low Melt Binder Fiber Samples | | |
|---|---|---|
| Applied Load (lbs) | Loft (inches) | Percent Loft (%) |
| Control | | |
| Blend (20% 4 dpf low melt, 30% 25 dpf PET, and 50% 15 dpf PET) | | |
| Rate: 920 lbs/hr | Weight: 1.0 oz/ft$^2$ | Number of Laps: 3 |
| Zero | 2.82 | 100 |
| 5 | 2.14 | 75.9 |
| 10 | 1.75 | 62.1 |
| 15 | 1.43 | 50.7 |
| 20 | 1.3 | 46.1 |
| Load removed | 2.7 | 95.7 |
| | | (% loft recovery) |
| Sample 1 (10% Low melt fiber) | | |
| Blend (10% 4 dpf low melt, 35% 25 dpf PET, and 55% 15 dpf PET) | | |
| Rate: 1050 lbs/hr | Weight: 1.0 oz/ft$^2$ | Number of Laps: 3 |
| Zero | 2.41 | 100 |
| 5 | 1.76 | 73.0 |
| 10 | 1.43 | 59.3 |
| 15 | 1.25 | 51.9 |
| 20 | 1.11 | 46.1 |
| Load removed | 2.25 | 93.4 |
| | | (% loft recovery) |
| Sample 2 (10% Low melt fiber) | | |
| Blend (10% 4 dpf low melt, 35% 25 dpf PET, and 55% 15 dpf PET) | | |
| Rate: 1100 lbs/hr | Weight: 1.0 oz/ft$^2$ | Number of Laps: 4 |
| Zero | 2.71 | 100 |
| 5 | 2.05 | 75.6 |
| 10 | 1.69 | 62.4 |
| 15 | 1.43 | 52.8 |
| 20 | 1.3 | 48.0 |
| Load removed | 2.56 | 94.5 |
| | | (% loft recovery) |

Due to the lower weight percent of binder fiber, the Samples had a lower percent loft recover, respectively 93.4% and 94.5%, than that of the Control. Notwithstanding, the Samples exhibited more tensile strength uniformity in the machine and cross directions, as discussed in detail below. In many applications, the balanced tensile strengths and cost savings achieved by increased production rate and using less of the comparatively expensive low melt fibers are more important than the disadvantage of a reduction in loft recovery.

The tensile strength for the Control and Samples of Table 5 are set forth in Table 6.

TABLE 6

| (Tensile Strength in pounds) | | | |
|---|---|---|---|
| | Control | Sample 1 | Sample 2 |
| MD | 3.3 | 6.2 | 4.1 |
| CD | 8.75 | 6.7 | 4.05 |

The drafted Samples had a reduced weight percent of low melt fibers. Since low melt fibers are used bond the fibers, standard convention would dictate that decreasing the weight percent of these fibers would reduce the tensile strength of the fabric. Surprisingly, the drafted Samples had tensile strength in the machine direction that exceeded that of the Control.

Although the drafted Samples did decrease in tensile strength in the cross direction, the tensile strength in the cross and machine directions were now substantially balanced. Since the low melt fabrics do not exhibit a gross weakness in either direction, they can be applied to many applications, but at a lower cost than conventionally manufactured fabric.

EXAMPLE 4

Table 7 shows the percent loft recovery for 1.25 oz/ft$^2$ Control and two Sample fabrics.

TABLE 7

| Percent Loft Recovery for 1.25 oz/ft$^2$ Control and Samples | | |
|---|---|---|
| Applied Load (lbs) | Loft (inches) | Percent Loft (%) |
| Control | | |
| Blend (20% 4 dpf low melt, 30% 25 dpf PET, and 50% 15 dpf PET) | | |
| Rate 1385 lbs/hr | Weight: 1.25 oz/ft$^2$ | Number of Laps: 3 |
| Zero | 2.86 | 100 |
| 5 | 2.3 | 80.4 |
| 10 | 1.95 | 68.2 |
| 15 | 1.71 | 59.8 |
| 20 | 1.54 | 53.8 |
| Load removed | 2.74 | 95.8 |
| | | (% loft recovery) |
| Sample 1 | | |
| Blend (20% 4 dpf low melt, 30% 25 dpf PET, and 50% 15 dpf PET) | | |
| Rate: 1700 lbs/hr | Weight: 1.25 oz/ft$^2$ | Number of Laps: 4 |
| Zero | 2.54 | 100 |
| 5 | 2.22 | 87.4 |
| 10 | 1.99 | 78.3 |
| 15 | 1.81 | 71.3 |
| 20 | 1.65 | 65.0 |
| Load removed | 2.46 | 96.9 |
| | | (% loft recovery) |
| Sample 2 | | |
| Blend (20% 4 dpf low melt, 30% 25 dpf PET, and 50% 15 dpf PET) | | |
| Rate: 1300 lbs/hr | Weight: 1.25 oz/ft$^2$ | Number of Laps: 5 |
| Zero | 2.72 | 100 |
| 5 | 2.42 | 89.0 |

TABLE 7-continued

| Percent Loft Recovery for 1.25 oz/ft$^2$ Control and Samples | | |
|---|---|---|
| Applied Load (lbs) | Loft (inches) | Percent Loft (%) |
| 10 | 2.2 | 80.9 |
| 15 | 2.0 | 73.5 |
| 20 | 1.86 | 68.4 |
| Load removed | 2.66 | 97.8 |
| | | (% loft recovery) |

As with the previous examples, drafting improved the resiliency of the fabric, as measured by percent loft recovery. In this experiment, the percent recovery for Samples 1 and 2 were respectively 96.9% and 97.8%, compared to a loft recovery of 95.8% for the Control. Table 7 also shows that the drafted Samples have less false loft than the Control. These advantages in fabric quality are achieved even though the Samples were manufactured at a higher production rate than the Control.

It is noted that the production rate of Sample 2 is less than that of the Control. However, this lower rate was due to the maximum operation capacity of the cross lapper, and not related to the use of the drafter enhanced process in manufacturing the Sample. As such, it is extrapolated that the quality of Sample 2 will be superior to that of the Control, even at higher production rates.

Table 8 shows the tensile strength for the Control and Samples set forth in Table 7.

TABLE 8

| (Tensile Strength in pounds) | | | |
|---|---|---|---|
| | Control | Sample 1 | Sample 2 |
| MD | 4.1 | 9.0 | 14.1 |
| CD | 12.4 | 13.0 | 16.5 |

Table 8 illustrates that by adding the drafter to the nonwoven process, tensile strength in the machine direction was substantially improved while tensile strength in the cross direction remained relatively unchanged. As such, tensile strengths in the machine and cross directions are more uniform.

EXAMPLE 5

The percent loft recovery for the invented process was also compared to that of a conventional process which uses latex resin as a binder. It is known that typically latex resin produces superior loft recovery properties compared to a nonwoven high loft using a low melt binder fiber. The use of the drafter makes a fabric that is more uniform such that the loft recovery is similar even if you use a latex resin binder or a low melt binder fiber. The results are set forth in Table 9.

TABLE 9

| Percent Loft Recovery for 0.75 oz/ft$^2$ Samples and Resin Control | | |
|---|---|---|
| Applied Load (lbs) | Loft (inches) | Percent Loft (%) |
| Resin Control<br>Blend (100% 15 dpf PET, Resin Add On 17.80%)<br>Rate: 450 lbs/hr Weight: 0.75 oz/ft$^2$ | | |
| Zero | 1.51 | 100 |
| 5 | 1.19 | 82.1 |
| 10 | 0.99 | 65.4 |

TABLE 9-continued

| Percent Loft Recovery for 0.75 oz/ft$^2$ Samples and Resin Control | | |
|---|---|---|
| Applied Load (lbs) | Loft (inches) | Percent Loft (%) |
| 15 | 0.83 | 54.8 |
| 20 | 0.73 | 48.5 |
| Load removed | 1.46 | 97.0 |
| | | (% loft recovery) |
| Sample<br>Blend (20% 4 dpf low melt, 30% 25 dpf PET, and 50% 15 dpf PET)<br>Rate: 1700 lbs/hr Weight: 0.75 oz/ft$^2$ | | |
| Zero | 1.51 | 100 |
| 5 | 1.24 | 82.1 |
| 10 | 1.08 | 71.5 |
| 15 | 0.97 | 64.2 |
| 20 | 0.88 | 58.3 |
| Load removed | 1.46 | 96.7 |
| | | (% loft recovery) |

As shown in Table 9, the Sample exhibited comparable results in percent loft recovery to that of the Control, 96.7% to 97.0%. Notably, however, the production rate for the Sample was significantly faster than that for the Control: 1700 lbs/hr compared to 450 lbs/hr.

From the foregoing, it is apparent that there has been provided, in accordance with the invention, an improved process for manufacturing light-weight, high loft, nonwoven fabric that fully satisfies the objects, aims and advantages set forth above. Although the invention has been described in conjunction with specific embodiments thereof, it is evident that many alternatives, modifications, and variations would be apparent to those skilled in the art in light of the foregoing description. Accordingly, it is intended to embrace all such alternatives, modifications, and variations as fall within the spirit and broad scope of the invention.

What is claimed is:

1. A process of making high loft, nonwoven material, comprising the steps of:

providing natural and/or synthetic fibers;

providing low melt binder fibers, wherein the binder fibers comprises low melt fibers or bicomponent fibers;

mixing said low melt fibers and said natural and/or synthetic fibers to form a web;

cross lapping the web;

drafting the web with a drafter;

heating the drafted web to a temperature sufficient to melt the low melt binder fibers; and cooling the web, whereby the nonwoven material is formed.

2. The process of claim 1, further including the step of attenuating the web with the drafter.

3. The process of claim 1, wherein the drafter comprising a plurality of zones, wherein each zone includes rollers, and wherein said rollers in each subsequent zone rotate at the same or greater rpm than the rollers in a previous zone.

4. The process of claim 1, wherein the nonwoven material has a weight that is no more than 2.0 oz/ft$^2$ and has a tensile strength in a machine direction that is at least 50 percent of the tensile strength in a cross direction.

5. A process of making high loft, nonwoven batt, comprising the steps of:

providing natural and/or synthetic fibers;

providing low melt binder fibers, wherein said binder fibers comprises low melt fibers or bicomponent fibers;

mixing said low melt fibers and said natural and/or synthetic fibers to form a web;

cross lapping the web, wherein said cross lapping provides between 2 to 10 layers, thus forming a batt;

drafting said batt with a drafter;

heating said drafted batt to a temperature sufficient to melt the low melt binder fibers; and cooling said batt, said batt having a tensile strength in a machine direction that is at least 50 percent of the tensile strength in a cross direction.

6. The process of claim 5, wherein said synthetic fiber is selected from the class of polyester, polyamide, polyolefin, polyacrylic, cellulose acetate, melamine, rayon, mixtures of these, or copolymers of these.

7. The process of claim 5, wherein said natural fiber is selected from the class of cotton, wool, flax, kenaf, hemp, silk, jute, asbestos, ramie, or mixtures of these.

8. The process of claim 6, wherein said natural fiber is selected from the class of cotton, wool, flax, kenaf, hemp, silk, jute, asbestos, ramie, or mixtures of these.

9. The process of claim 5, wherein the weight of said batt is in the range of 0.25 oz/ft$^2$ to 2.0 oz/ft$^2$.

10. The process of claim 9, having a loft recovery of at least 90% under a load of 10 lbs per sq. ft, for a duration of 2 minutes.

11. The process of claim 5, wherein said low melt binder comprises no more than about 30 percent by weight, of the batt.

12. The process of claim 5, wherein said batt comprises from about 10 to about 20 wt. % low melt binder fibers and wherein said synthetic fiber comprises from about 80 to about 90 wt. % polyester fiber.

13. The process of claim 12, wherein said polyester comprises fibers of different denier.

14. The process of claim 13, wherein said denier is from about 15 to about 25.

15. The process of claim 5, wherein said low melt binder fibers comprises from about 5 to about 25 wt % of said batt.

16. A process of making high loft, nonwoven batt, comprising the steps of:

providing polyester fibers;

providing low melt binder fibers, wherein said binder fibers comprises low melt fibers or bicomponent fibers, said low melt binder fibers comprises no more than about 30 percent by weight, of the batt;

mixing said low melt fibers and said polyester fibers to form a web;

cross lapping the web, wherein said cross lapping provides between 2 to 10 layers, thus forming a batt, wherein the weight of said batt is in the range of 0.25 oz/ft$^2$ to 2.0 oz/ft$^2$;

drafting said batt with a drafter;

heating said drafted batt to a temperature sufficient to melt at least a portion of said low melt binder fibers; and cooling said batt, said batt having a tensile strength in a machine direction that is at least 50 percent of the tensile strength in a cross direction.

17. The process of claim 16, wherein said tensile strength in the machine direction is greater than the tensile strength in the cross direction.

* * * * *